US007226400B1

(12) United States Patent
Gedeon-Janvier

(10) Patent No.: US 7,226,400 B1
(45) Date of Patent: Jun. 5, 2007

(54) WEIGHT BENCH APPARATUS

(76) Inventor: Maxime Gedeon-Janvier, 376 Sheridan Blvd., Inwood, NY (US) 11096

( * ) Notice: Subject to any disclaimer, the term of this patent is extended or adjusted under 35 U.S.C. 154(b) by 39 days.

(21) Appl. No.: 11/253,888

(22) Filed: Oct. 18, 2005

Related U.S. Application Data

(63) Continuation-in-part of application No. 10/441,313, filed on May 19, 2003, now abandoned.

(51) Int. Cl.
*A63B 21/078* (2006.01)

(52) U.S. Cl. ..... 482/104; 482/106; 482/108; 482/142; 482/145

(58) Field of Classification Search ..... 482/93, 482/94, 97, 104, 106, 108, 142, 145
See application file for complete search history.

(56) References Cited

U.S. PATENT DOCUMENTS 4,302,009 A * 11/1981 Johnson ..... 482/104
4,650,186 A * 3/1987 McCreery et al. ..... 482/104
4,875,676 A * 10/1989 Zimmer ..... 482/104
4,973,050 A * 11/1990 Santoro et al. ..... 482/102
5,411,459 A 5/1995 Hayden
5,462,507 A 10/1995 Nichols, Sr. et al.
5,472,397 A 12/1995 Ammoscato et al.
5,477,397 A 12/1995 Naimpally et al.
5,549,531 A * 8/1996 Campbell ..... 482/106
5,823,921 A 10/1998 Dawson
5,954,619 A * 9/1999 Petrone ..... 482/104
5,971,898 A * 10/1999 Schoolfield ..... 482/104
5,989,166 A 11/1999 Capizzo et al.
D441,813 S 5/2001 Ceppo
6,450,927 B1 * 9/2002 Ellis ..... 482/94
6,482,135 B1 * 11/2002 Ish et al. ..... 482/97
6,689,027 B1 2/2004 Gardikis, Jr.
2006/0148624 A1 * 7/2006 Bae ..... 482/93

FOREIGN PATENT DOCUMENTS

GB 2270267 A * 3/1994
WO WO 2005070503 A1 * 8/2005

* cited by examiner

*Primary Examiner*—Jerome Donnelly
*Assistant Examiner*—Victor K. Hwang

(57) ABSTRACT

A weight bench apparatus for to allow a user to lift weights without a spotter. The weight bench apparatus includes a bench assembly being designed for being positioned on a support surface and for supporting the user. A pair of support assemblies is pivotally coupled to the bench assembly for supporting a weight training member being used by the user. A foot assembly is operationally coupled to the bench assembly. The foot assembly is operationally coupled to the support assemblies whereby the foot assembly pivots the support assemblies from a vertical position to a substantially horizontal position to allow the user to freely use the weight training member when the foot assembly is actuated by feet of the user. The support assemblies are designed for receiving the weight training member when the support assemblies are actuated by the foot assembly and pivoted back to a vertical position.

20 Claims, 4 Drawing Sheets

WEIGHT BENCH APPARATUS

REFERENCE TO RELATED APPLICATION

The present application is a continuation-in-part of U.S. patent application Ser. No. 10/441,313, filed May 19, 2003, now abandoned, which is incorporated herein by reference in its entirety.

BACKGROUND OF THE INVENTION

1. Field of the Invention

The present invention relates to weight benches and more particularly pertains to a new weight bench apparatus for to allow a user to lift weights without a spotter.

2. Description of the Prior Art

The use of weight benches is known in the prior art. U.S. Pat. No. 5,462,507 describes a device for docking an exercise machine. Another type of weight bench is U.S. Pat. No. 5,823,921 having a exercise machine that has a barbell connected to a cable system for lifting the barbell away from the user when the user can no longer lift the barbell. U.S. Pat. No. 5,411,459 has a dumbbell rack attachment for a weight bench to support dumbbells to be used by a user positioned on the weight bench. U.S. Pat. No. 5,472,397 has an exercise bench that supports a pair of dumbbells on opposed sides of the bench to be used by the user. U.S. Pat. No. 5,989,166 has a portable apparatus for assisting weight lifters during weight lifting to prevent injury. U.S. Pat. No. Des. 441,813 shows a dumbbell holder stand support.

While these devices fulfill their respective, particular objectives and requirements, the need remains for a device that has certain improved features for assisting a user during weight lifting.

SUMMARY OF THE INVENTION

The present invention meets the needs presented above by providing a foot assembly that is pushed on to rotate the support assemblies to the horizontal position and lifted to allow the support assemblies to pivot to the vertical position.

Still yet another object of the present invention is to provide a new weight bench apparatus that provides the user with two separate motions to pivot the support assemblies to reduce the chance of confusion while lifting weights.

To this end, the present invention generally comprises a bench assembly being designed for being positioned on a support surface whereby the bench assembly is designed for supporting the user. A pair of support assemblies are pivotally coupled to the bench assembly whereby each of the support assemblies is designed for supporting a weight training member being used by the user. A foot assembly is operationally coupled to the bench assembly. The foot assembly is operationally coupled to the support assemblies whereby the foot assembly pivots the support assemblies from a vertical position to a substantially horizontal position to allow the user to freely use the weight training member when the foot assembly is actuated by feet of the user. The support assemblies are designed for receiving the weight training member when the support assemblies are actuated by the foot assembly and pivoted back to a vertical position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
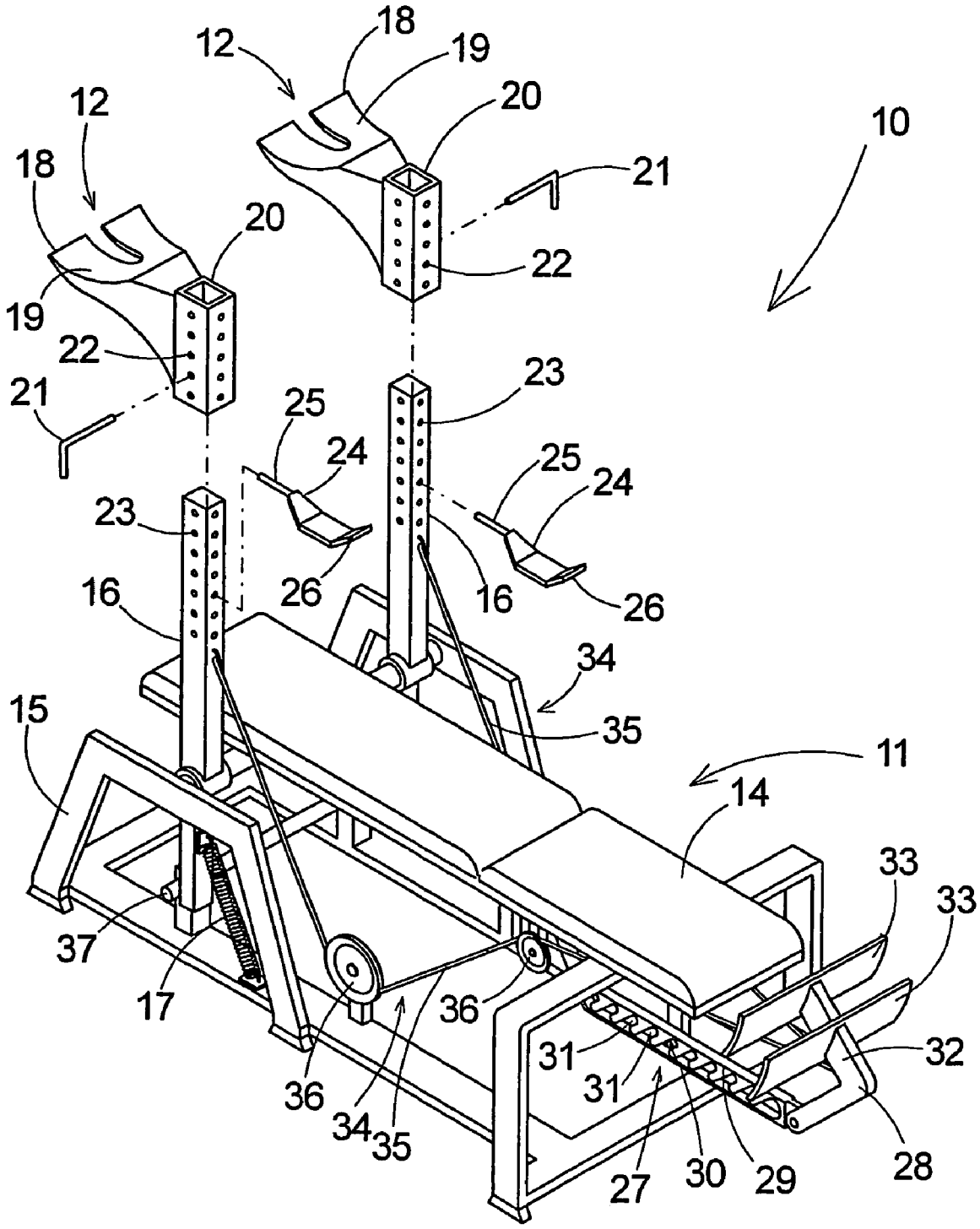
FIG. 1 is an exploded perspective view of a new weight bench apparatus according to the present invention.

With reference now to the drawings, and in particular to FIGS. 1 through 4 thereof, a new weight bench apparatus embodying the principles and concepts of the present invention and generally designated by the reference numeral 10 will be described.

Figure 2:
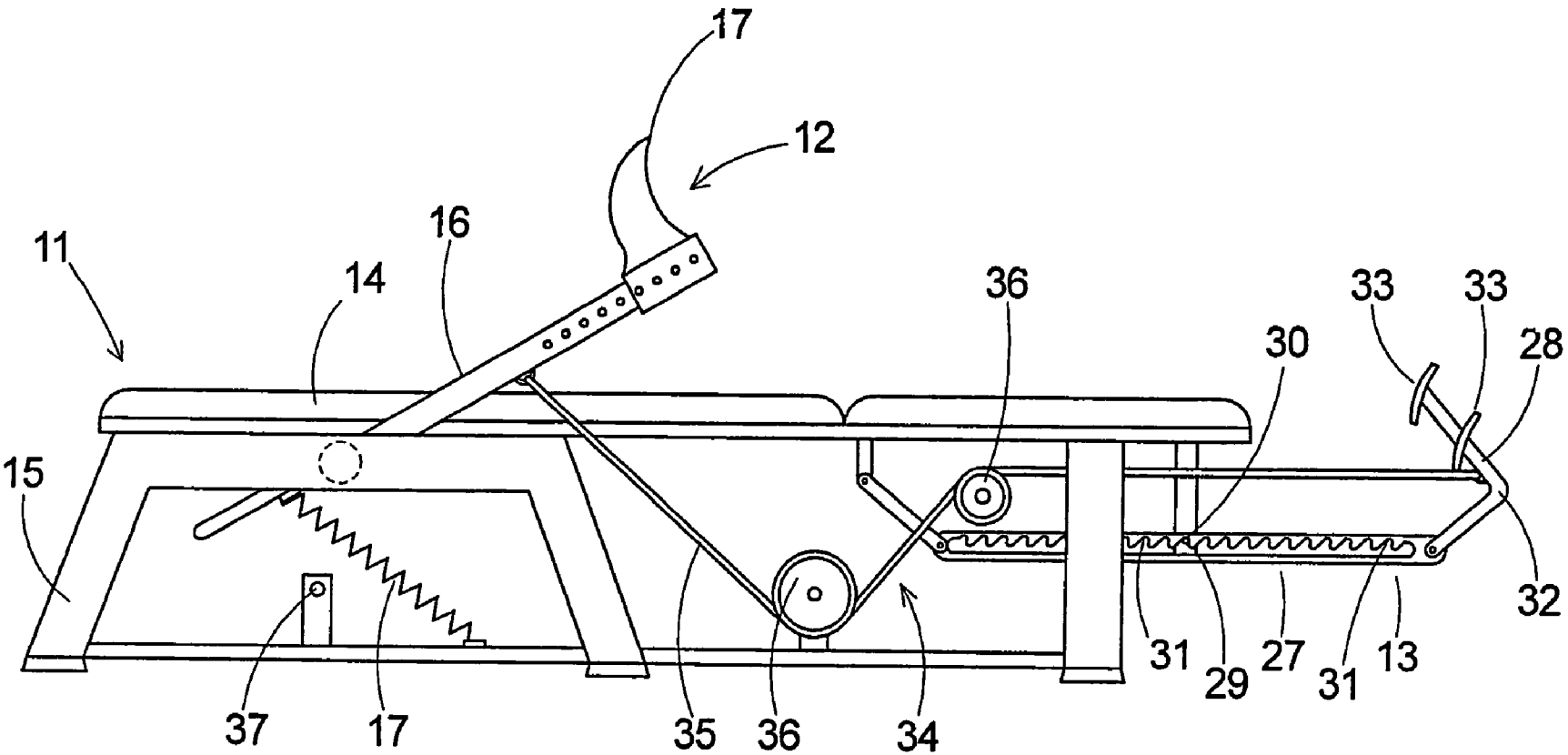
FIG. 2 is a side view of the present invention with the support assemblies in the horizontal position.

As best illustrated in FIGS. 1 and 2, the weight bench apparatus 10 generally comprises a bench assembly 11 being designed for being positioned on a support surface whereby the bench assembly 11 is designed for supporting the user.

A pair of support assemblies 12 is pivotally coupled to the bench assembly 11 whereby each of the support assemblies 12 is designed for supporting a weight training member being used by the user.

A foot assembly 13 is operationally coupled to the bench assembly 11. The foot assembly 13 is operationally coupled to the support assemblies 12 whereby the foot assembly 13 pivots the support assemblies 12 from a vertical position to a substantially horizontal position to allow the user to freely use the weight training member when the foot assembly 13 is actuated by feet of the user. The support assemblies 12 are designed for receiving the weight training member when the support assemblies 12 are actuated by the foot assembly 13 and pivoted back to a vertical position.

The bench assembly 11 comprises a bench member 14 and a frame assembly 15. The frame assembly 15 is designed for being positioned on a support surface. The bench member 14 is coupled to the frame assembly 15 whereby the bench member 14 is selectively positioned at a desired angle to the support surface. The bench member 14 is designed for supporting the user.

Each of the support assemblies 12 comprises a stanchion member 16 and a biasing member 17. The stanchion member 16 is pivotally coupled to the bench assembly 11. The biasing member 17 extends between the stanchion member 16 of the associated one of the support assemblies 12 and the bench assembly 11. The biasing member 17 biases the stanchion member 16 of the associated one of the support assemblies 12 to the vertical position when the foot assembly 13 is actuated by the user.

Each of the support assemblies 12 comprises a dumbbell member 18. The dumbbell member 18 is selectively coupled to the stanchion member 16 of the associated one of the support assemblies 12. The dumbbell member 18 of each of the support assemblies 12 is designed for supporting one of a pair of dumbbells to be used by the user when the support assemblies 12 are in the vertical position.

The dumbbell member 18 of each of the support assemblies 12 comprises a support portion 19 and a sleeve portion 20. The support portion 19 is coupled to the sleeve portion 20 whereby the support portion 19 extends outwardly from the sleeve portion 20. The support portion 19 is designed for receiving one of the dumbbells to be supported. The sleeve portion 20 receives the stanchion member 16 of the associated one of the support assemblies 12 to mount the support portion 19 to the stanchion member 16 of the associated one of the support assemblies 12.

Each of the support assemblies 12 comprises a locking pin 21. The locking pin 21 is selectively inserted through one of a plurality of mounting apertures 22 of the sleeve portion 20 selectively aligned with one of a plurality of positioning apertures 23 extending through the stanchion member 16 of the associated one of the support assemblies 12 to allow the dumbbell member 18 to be selectively positioned, vertically or rotationally, on the stanchion member 16 of the associated one of the support assemblies 12.

Each of the support assemblies 12 comprises a barbell member 24. The barbell member 24 is selectively coupled to the stanchion member 16 of the associated one of the support assemblies 12. The barbell member 24 of each of the support assemblies 12 is designed for receiving and supporting a barbell when the support assemblies 12 are in the vertical position.

The barbell member 24 of each of the support assemblies 12 comprises a pin portion 25 and a receiving portion 26. The pin portion 25 is coupled to the receiving portion 26 whereby the pin portion 25 extends away from the receiving portion 26. The pin portion 25 is selectively inserted in one of the positioning apertures 23 of the stanchion member 16 of the associated one of the support assemblies 12 whereby the receiving portion 26 is selectively coupled to the stanchion member 16 when the dumbbell members 18 are removed from the stanchion member 16 of the associated one of the support assemblies 12. The receiving portion 26 is designed for receiving the barbell when the support assemblies 12 are in the vertical position.

The foot assembly 13 comprises a carriage assembly 27 and a foot member 28. The carriage assembly 27 is operationally coupled to the bench assembly 11. The foot member 28 is operationally coupled to the stanchion member 16 of each of the support assemblies 12 whereby the foot member 28 is for pivoting the stanchion member 16 of the support assemblies 12 when the foot member 28 is actuated with respect to the bench assembly 11. The carriage assembly 27 is coupled to the foot member 28. The carriage assembly 27 is for indexing the foot member 28 and retaining the support assemblies 12 in a substantially horizontal position when the foot member 28 is actuated by feet of the user.

The carriage assembly 27 comprises an indexing member 29 and an indexing pin 30. The indexing member 29 comprises a plurality of angled slots 31 extending through the indexing member 29. The indexing pin 30 is coupled to the bench assembly 11 whereby the indexing pin 30 selectively extends through one of the angled slots 31 of the indexing member 29. Each of the angled slots 31 of the indexing member 29 is angled away from the foot member 28 whereby the angled slots 31 provided minimal resistance to the indexing pin 30 sliding out of the associated one of the angled slots 31 when the foot member 28 is engaged by the feet of the user. The angled slots 31 of the indexing member 29 resist sliding of the indexing from the associated one of the angled slots 31 when the foot member 28 is not engaged by the feet of the user.

The foot member 28 comprises a link portion 32 and a plurality of foot portions 33. The link portion 32 is coupled to the carriage assembly 27. The foot portions 33 are coupled to the link portion 32 whereby the foot portions 33 are positioned opposite the carriage assembly 27. The foot portions 33 are designed for being engaged by the feet of the user to rotate the support assemblies 12 by pushing the foot member 28 away from the support assemblies 12. The foot portions 33 are designed for being engaged by the feet of the user to lift the foot member 28 and actuate the carriage assembly 27 and permit the support assemblies 12 to rotate to the vertical position.

The foot assembly 13 comprises a pair of cable assemblies 34. Each of the cable assemblies 34 is operationally coupled between one of the support assemblies 12 and the foot member 28 of the foot assembly 13. The cable assemblies 34 are for pivoting the support assemblies 12 when the foot member 28 is actuated by the feet of the user.

Each of the cable assemblies 34 comprises a cable member 35 and a plurality of pulleys 36. Each of the pulleys 36 is coupled to the bench assembly 11. The cable member 35 is coupled between foot member 28 and the stanchion member 16 of the associated one of the support assemblies 12. The cable member 35 is operationally coupled to the pulleys 36 whereby actuation of the foot member 28 actuates the cable member 35 of each of the cable assemblies 34 to pivot the stanchion member 16 of each of the support assemblies 12.

At least one securing pin 37 is selectively coupled to the bench assembly 11. The securing pin 37 selectively engaging at least one of the support assemblies 12 whereby the securing pin 37 inhibits pivoting of the support assemblies 12 with respect to the bench assembly 11.

Figure 3:
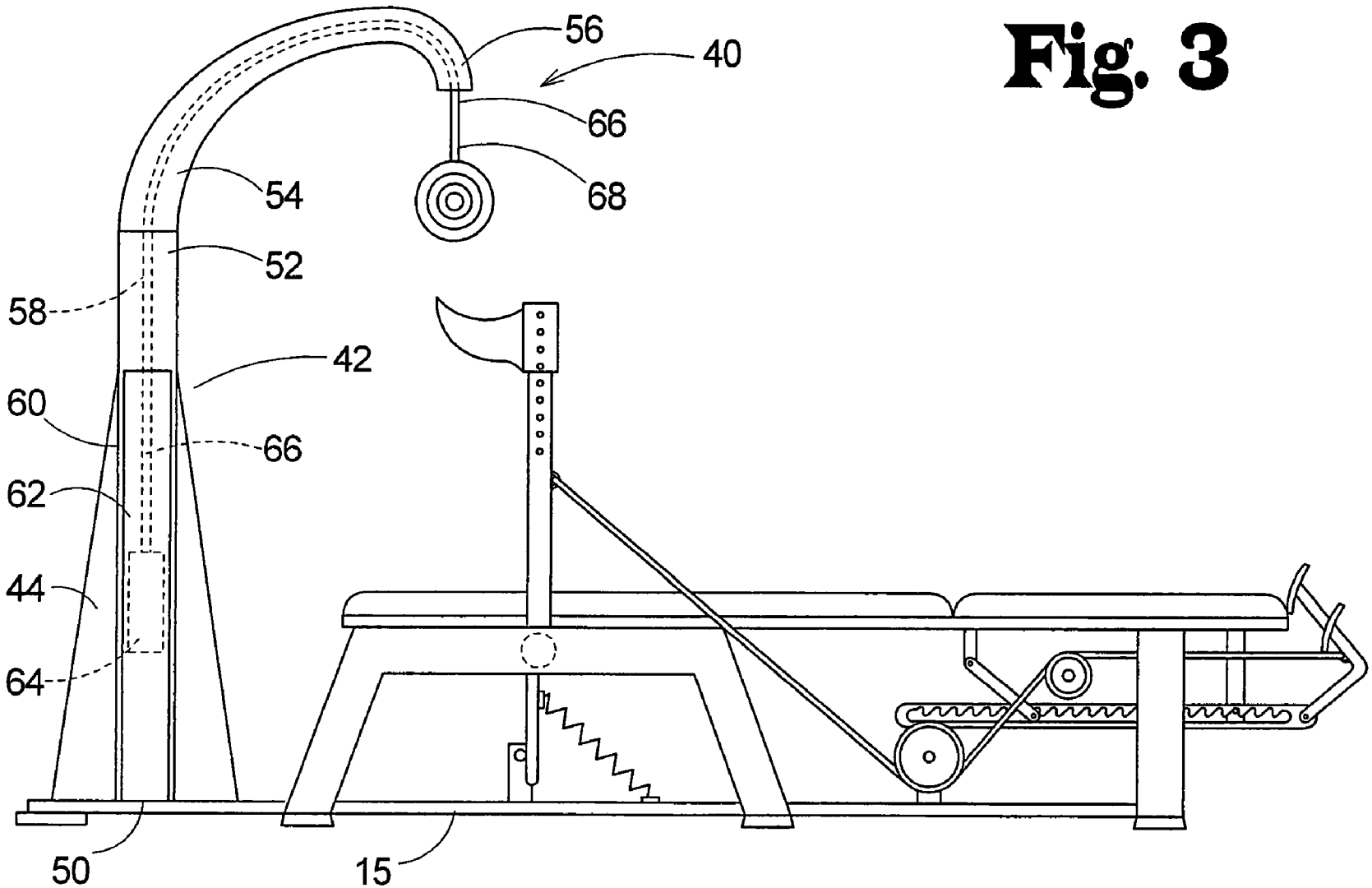
FIG. 3 is a side view of the present invention with the support assemblies in the vertical position, and including the optional cable safety apparatus.
Figure 4:
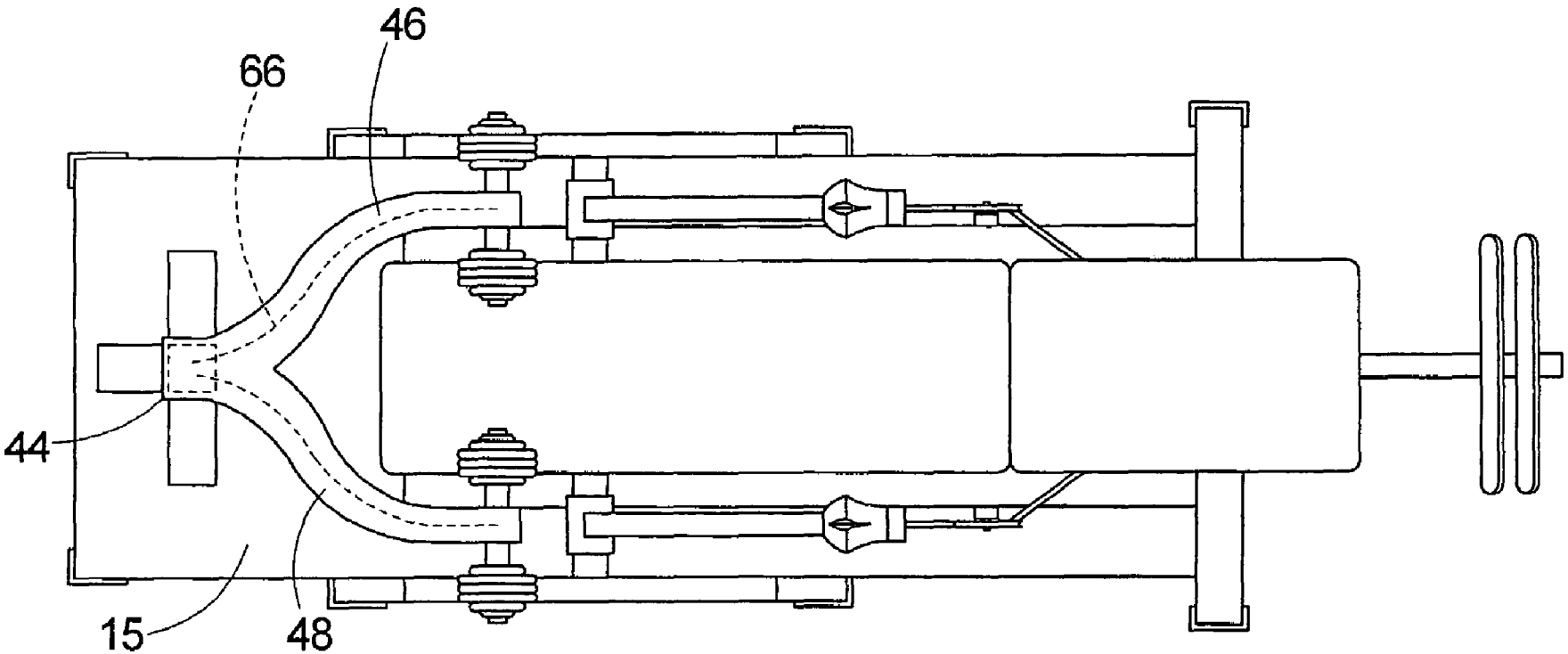
FIG. 4 is a top view of the weight bench apparatus with the optional cable safety apparatus.

In an optional embodiment of the invention shown in FIGS. 3 and 4, a cable safety apparatus 40 is provided for providing support to dumbbells 18 when used with the bench assembly 11 of the weight bench apparatus 10. The cable safety apparatus 40 comprises a standard assembly 42 mounted on the frame assembly 15 adjacent to the support assemblies 12 when the support assemblies are in the vertical position. The standard assembly 42 comprising a base 44 and a pair of arms 46, 48 extending from the base 44. The base 44 has a lower end 50 and an upper end 52. The lower end 50 is mounted on the frame assembly 15. The arms 46, 48 extend from the upper end 52 of the base 44, and each of the arms has an inboard end 54 mounted on the base 44. Each of the arms 46, 48 terminate at an outboard end 56. The arms 46, 48 may diverge from each other in a substantially V-shaped configuration. A channel 58 extends through each of the arms 46, 48 from the inboard end 54 to the outboard end 56. The base 44 comprises an upstanding tube 60, and the upstanding tube defines a receiving chamber 62. The channel 58 of each of the arms 46, 48 is in communication with the receiving chamber 62 in the base 44. The arms 46, 48 may be generally arcuate in shape with the inboard 54 and outboard 56 ends being directed downwardly.

A counterweight 64 is positioned in the receiving chamber 62 and being movable in the receiving chamber. A cable 66 extends through the channel 58 in each of the arms 46, 48, and the cable is mounted on the counterweight 64. The cable 66 has a free end 68 that is located opposite of the counterweight 64, and the free end 68 may be mounted on a dumbbell 18 so that the dumbbell is restricted from quickly moving in a downward direction and possibly injuring the user. The cable 66 connected to the counterweight 64 impedes the downward motion of the connected dumbbell in case the user loses control of the dumbbell. The connection between the free end of the cable and the dumbbell is preferable disconnectable so that various dumbbells may be used with the cable safety apparatus.

In use, the user couples either the dumbbell members 18 or the barbell members 24 to the stanchion member 16 of each of the support members depending on the desired exercise to be performed by the user. The user then lies on the bench member 14 and removes either the dumbbells from the dumbbell members 18 or the barbell from the barbell members 24. The user then places their feet on the foot member 28 of the foot assembly 13 and pushes on the foot member 28 which rotates the support assemblies 12 to the horizontal position and out of the way of the user. After the user has finished exercising with the dumbbells or the barbell the user lifts up on the foot member 28 of the foot assembly 13 which disengages the indexing member 29 from the indexing pin 30 and allows the biasing member 17 of each of the support assemblies 12 to return the support assemblies 12 to the vertical position to receive the dumbbells or the barbell to eliminate the need for a spotter for the user.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A weight bench apparatus for assisting a user in lifting weights to prevent injury to the user, the weight bench apparatus comprising:

a bench assembly being adapted for being positioned on a support surface such that said bench assembly is adapted for supporting the user;

a pair of support assemblies being pivotally coupled to said bench assembly such that each of said support assemblies is adapted for supporting a weight training member being used by the user; and a foot assembly being operationally coupled to said bench assembly, said foot assembly being operationally coupled to said support assemblies such that said foot assembly pivots said support assemblies from a vertical position to a substantially horizontal position to allow the user to freely use the weight training member when said foot assembly is actuated by feet of the user, said support assemblies being adapted for receiving the weight training member when said support assemblies are actuated by said foot assembly and pivoted back to a vertical position.

2. The weight bench apparatus as set forth in claim 1, further comprising:

said bench assembly comprising a bench member and a frame assembly, said frame assembly being adapted for being positioned on a support surface, said bench member being coupled to said frame assembly such that said bench member is selectively positioned at a desired angle to the support surface, said bench member being adapted for supporting the user.

3. The weight bench apparatus as set forth in claim 1, further comprising:

each of said support assemblies comprising a stanchion member and a biasing member, said stanchion member being pivotally coupled to said bench assembly, said biasing member extending between said stanchion member of the associated one of said support assemblies and said bench assembly, said biasing member biasing said stanchion member of the associated one of said support assemblies to the vertical position when said foot assembly is actuated by the user.

4. The weight bench apparatus as set forth in claim 3, further comprising:

each of said support assemblies comprising a dumbbell member, said dumbbell member being selectively coupled to said stanchion member of the associated one of said support assemblies, said dumbbell member of each of said support assemblies being adapted for supporting one of a pair of dumbbells to be used by the user when said support assemblies are in the vertical position.

5. The weight bench apparatus as set forth in claim 4, further comprising:

said dumbbell member of each of said support assemblies comprising a support portion and a sleeve portion, said support portion being coupled to said sleeve portion such that said support portion extends outwardly from said sleeve portion, said support portion being adapted for receiving one of the dumbbells to be supported, said sleeve portion receiving said stanchion member of the associated one of said support assemblies to mount said support portion to said stanchion member of the associated one of said support assemblies.

6. The weight bench apparatus as set forth in claim 5, further comprising:

each of said support assemblies comprising a locking pin, said locking pin being selectively inserted through one of a plurality of mounting apertures of said sleeve portion selectively aligned with one of a plurality of positioning apertures extending through said stanchion member of the associated one of said support assemblies to allow said dumbbell member to be selectively positioned on said stanchion member of the associated one of said support assemblies.

7. The weight bench apparatus as set forth in claim 3, further comprising:

each of said support assemblies comprising a barbell member, said barbell member being selectively coupled to said stanchion member of the associated one of said support assemblies, said barbell member of each of said support assemblies being adapted for receiving and supporting a barbell when said support assemblies are in the vertical position.

8. The weight bench apparatus as set forth in claim 7, further comprising:

said barbell member of each of said support assemblies comprising a pin portion and a receiving portion, said pin portion is coupled to said receiving portion such that said pin portion extends away from said receiving portion, said pin portion being selectively inserted in one of a plurality of positioning apertures of said stanchion member of the associated one of said support assemblies such that said receiving portion is selectively coupled to said stanchion member, said receiving portion being adapted for receiving the barbell when said support assemblies are in the vertical position.

9. The weight bench apparatus as set forth in claim 3, further comprising:

said foot assembly comprising a carriage assembly and a foot member, said carriage assembly being operationally coupled to said bench assembly, said foot member being operationally coupled to said stanchion member of each of said support assemblies such that said foot member is for pivoting said stanchion member of said support assemblies when said foot member is actuated with respect to said bench assembly, said carriage assembly being coupled to said foot member, said carriage assembly being for indexing said foot member and retaining said support assemblies in a substantially horizontal position when said foot member is actuated by feet of the user.

10. The weight bench apparatus as set forth in claim 9, further comprising:

said carriage assembly comprising an indexing member and an indexing pin, said indexing member comprising a plurality of angled slots extending through said indexing member, said indexing pin being coupled to said bench assembly such that said indexing pin selectively extends through one of said angled slots of said indexing member, each of said angled slots of said indexing member being angled away from said foot member such that said angled slots provided minimal resistance to said indexing pin sliding out of the associated one of said angled slots when said foot member is engaged by the feet of the user, said angled slots of said indexing member resisting sliding of said indexing from the associated one of said angled slots when said foot member is not engaged by the feet of the user.

11. The weight bench apparatus as set forth in claim 9, further comprising:

said foot member comprising a link portion and a plurality of foot portions, said link portion is coupled to said carriage assembly, said foot portions being coupled to said link portion such that said foot portions are positioned opposite said carriage assembly, said foot portions being adapted for being engaged by the feet of the user to rotate said support assemblies by pushing said foot member away from said support assemblies, said foot portions being adapted for being engaged by the feet of the user to lift said foot member and actuate said carriage assembly and permit said support assemblies to rotate to the vertical position.

12. The weight bench apparatus as set forth in claim 9, further comprising:

said foot assembly comprising a pair of cable assemblies, each of said cable assemblies being operationally coupled between one of said support assemblies and said foot member of said foot assembly, said cable assemblies being for pivoting said support assemblies when said foot member is actuated by the feet of the user.

13. The weight bench apparatus as set forth in claim 12, further comprising:

each of said cable assemblies comprising a cable member and a plurality of pulleys, each of said pulleys being coupled to said bench assembly, said cable member being coupled between foot member and said stanchion member of the associated one of said support assemblies, said cable member being operationally coupled to said pulleys such that actuation of said foot member actuates said cable member of each of said cable assemblies to pivot said stanchion member of each of said support assemblies.

14. The weight bench apparatus as set forth in claim 1, further comprising:

at least one securing pin being selectively coupled to said bench assembly, said securing pin selectively engaging at least one of said support assemblies such that said securing pin inhibits pivoting of said support assemblies with respect to said bench assembly.

15. The weight bench apparatus as set forth in claim 1, further comprising a cable safety apparatus for providing support to dumbbells when used with the bench assembly.

16. The weight bench apparatus as set forth in claim 15, wherein the cable safety apparatus comprises:

a standard assembly mounted on the frame assembly adjacent to the support assemblies when the support assemblies are in the vertical position, the standard assembly comprising a base and a pair of arms extending from the base.

17. The weight bench apparatus as set forth in claim 16, wherein the base of the standard assembly has a lower end and an upper end, the lower end being mounted on the frame assembly, the arms extending from the upper end of the base, each of the arms having an inboard end mounted on the base, each of the arms terminating at an outboard end, the arms diverging from each other.

18. The weight bench apparatus as set forth in claim 17, further comprising:

a channel extending through each of the arms from the inboard end to the outboard end, the base defining a receiving chamber, the channel of each of the arms being in communication with the receiving chamber in the base.

19. The weight bench apparatus as set forth in claim 18, further comprising:

a counterweight being positioned in the receiving chamber and being movable in the receiving chamber; and a cable extending through the channel in each of the arms, the cable being mounted on the counterweight, the cable having a free end opposite of the counterweight for mounting to a weight.

20. A weight bench apparatus for assisting a user in lifting weights to prevent injury to the user, the weight bench apparatus comprising:

a bench assembly being adapted for being positioned on a support surface such that said bench assembly is adapted for supporting the user;

a pair of support assemblies being pivotally coupled to said bench assembly such that each of said support assemblies is adapted for supporting a weight training member being used by the user;

a foot assembly being operationally coupled to said bench assembly, said foot assembly being operationally coupled to said support assemblies such that said foot assembly pivots said support assemblies from a vertical position to a substantially horizontal position to allow the user to freely use the weight training member when said foot assembly is actuated by feet of the user, said support assemblies being adapted for receiving the weight training member when said support assemblies are actuated by said foot assembly and pivoted back to a vertical position;

said bench assembly comprising a bench member and a frame assembly, said frame assembly being adapted for being positioned on a support surface, said bench member being coupled to said frame assembly such that said bench member is selectively positioned at a desired angle to the support surface, said bench member being adapted for supporting the user;

each of said support assemblies comprising a stanchion member and a biasing member, said stanchion member being pivotally coupled to said bench assembly, said biasing member extending between said stanchion member of the associated one of said support assemblies and said bench assembly, said biasing member biasing said stanchion member of the associated one of said support assemblies to the vertical position when said foot assembly is actuated by the user;

each of said support assemblies comprising a dumbbell member, said dumbbell member being selectively coupled to said stanchion member of the associated one of said support assemblies, said dumbbell member of each of said support assemblies being adapted for supporting one of a pair of dumbbells to be used by the user when said support assemblies are in the vertical position;

said dumbbell member of each of said support assemblies comprising a support portion and a sleeve portion, said support portion being coupled to said sleeve portion such that said support portion extends outwardly from said sleeve portion, said support portion being adapted for receiving one of the dumbbells to be supported, said sleeve portion receiving said stanchion member of the associated one of said support assemblies to mount said support portion to said stanchion member of the associated one of said support assemblies;

each of said support assemblies comprising a locking pin, said locking pin being selectively inserted through one of a plurality of mounting apertures of said sleeve portion selectively aligned with one of a plurality of positioning apertures extending through said stanchion member of the associated one of said support assemblies to allow said dumbbell member to be selectively positioned on said stanchion member of the associated one of said support assemblies;

each of said support assemblies comprising a barbell member, said barbell member being selectively coupled to said stanchion member of the associated one of said support assemblies, said barbell member of each of said support assemblies being adapted for receiving and supporting a barbell when said support assemblies are in the vertical position;

said barbell member of each of said support assemblies comprising a pin portion and a receiving portion, said pin portion is coupled to said receiving portion such that said pin portion extends away from said receiving portion, said pin portion being selectively inserted in one of said positioning apertures of said stanchion member of the associated one of said support assemblies such that said receiving portion is selectively coupled to said stanchion member when said dumbbell members are removed from said stanchion member of the associated one of said support assemblies, said receiving portion being adapted for receiving the barbell when said support assemblies are in the vertical position;

said foot assembly comprising a carriage assembly and a foot member, said carriage assembly being operationally coupled to said bench assembly, said foot member being operationally coupled to said stanchion member of each of said support assemblies such that said foot member is for pivoting said stanchion member of said support assemblies when said foot member is actuated with respect to said bench assembly, said carriage assembly being coupled to said foot member, said carriage assembly being for indexing said foot member and retaining said support assemblies in a substantially horizontal position when said foot member is actuated by feet of the user;

said carriage assembly comprising an indexing member and an indexing pin, said indexing member comprising a plurality of angled slots extending through said indexing member, said indexing pin being coupled to said bench assembly such that said indexing pin selectively extends through one of said angled slots of said indexing member, each of said angled slots of said indexing member being angled away from said foot member such that said angled slots provided minimal resistance to said indexing pin sliding out of the associated one of said angled slots when said foot member is engaged by the feet of the user, said angled slots of said indexing member resisting sliding of said indexing from the associated one of said angled slots when said foot member is not engaged by the feet of the user;

said foot member comprising a link portion and a plurality of foot portions, said link portion is coupled to said carriage assembly, said foot portions being coupled to said link portion such that said foot portions are positioned opposite said carriage assembly, said foot portions being adapted for being engaged by the feet of the user to rotate said support assemblies by pushing said foot member away from said support assemblies, said foot portions being adapted for being engaged by the feet of the user to lift said foot member and actuate said carriage assembly and permit said support assemblies to rotate to the vertical position;

said foot assembly comprising a pair of cable assemblies, each of said cable assemblies being operationally coupled between one of said support assemblies and said foot member of said foot assembly, said cable assemblies being for pivoting said support assemblies when said foot member is actuated by the feet of the user;

each of said cable assemblies comprising a cable member and a plurality of pulleys, each of said pulleys being coupled to said bench assembly, said cable member being coupled between foot member and said stanchion member of the associated one of said support assemblies, said cable member being operationally coupled to said pulleys such that actuation of said foot member actuates said cable member of each of said cable assemblies to pivot said stanchion member of each of said support assemblies;

at least one securing pin being selectively coupled to said bench assembly, said securing pin selectively engaging at least one of said support assemblies such that said securing pin inhibits pivoting of said support assemblies with respect to said bench assembly;

a cable safety apparatus for providing support to dumbbells when used with the bench assembly, wherein the cable safety apparatus comprises:

a standard assembly mounted on the frame assembly adjacent to the support assemblies when the support assemblies are in the vertical position, the standard assembly comprising a base and a pair of arms extending from the base;

wherein the base of the standard assembly has a lower end and an upper end, the lower end being mounted on the frame assembly, the arms extending from the upper end of the base, each of the arms having an inboard end mounted on the base, each of the arms terminating at an outboard end, the arms diverging from each other;

a channel extending through each of the arms from the inboard end to the outboard end, the base defining a receiving chamber, the channel of each of the arms being in communication with the receiving chamber in the base;

a counterweight being positioned in the receiving chamber and being movable in the receiving chamber; and a cable extending through the channel in each of the arms, the cable being mounted on the counterweight, the cable having a free end opposite of the counterweight for mounting to a weight.

* * * * *